United States Patent [19]

Davis et al.

[11] 4,012,000

[45] Mar. 15, 1977

[54] CRUSHING MACHINE CLEARING SYSTEM

[75] Inventors: D. Carter Davis, Menomonee Falls; Ulhas S. Sawant, Sussex, both of Wis.

[73] Assignee: Rexnord Inc., Milwaukee, Wis.

[22] Filed: May 27, 1975

[21] Appl. No.: 580,925

[52] U.S. Cl. ..... 241/290; 92/117 R; 241/207

[51] Int. Cl.[2] ..... B02C 2/04

[58] Field of Search ..... 241/207–216, 241/286, 290; 92/117 R, 129

[56] References Cited

UNITED STATES PATENTS

| | | | |
|---|---|---|---|
| 3,009,660 | 11/1961 | Symons et al. | 241/290 |
| 3,140,835 | 7/1964 | Balmer et al. | 241/286 |
| 3,273,810 | 9/1966 | Gasparac et al. | 241/290 |
| 3,797,760 | 3/1974 | Davis et al. | 241/207 UX |
| 3,837,585 | 9/1974 | Decker et al. | 241/215 X |

*Primary Examiner*—Granville Y. Custer, Jr.
*Assistant Examiner*—Howard N. Goldberg
*Attorney, Agent, or Firm*—Kinzer, Plyer, Dorn & McEachran

[57] ABSTRACT

This is concerned with a crusher clearing system using a plurality of hydraulic jacks disposed with relation to the adjustment ring and main frame of the crusher such that the jacks, as a unit, apply a generally vertical thrust directly between the upper main frame flange and the adjustment ring so that uncrushable material may be removed from the crushing cavity in a stalled or jammed crusher.

6 Claims, 2 Drawing Figures

200
202
204
206
208
210
212
214
216
218
220
222
224
226
228
230
232
234
236
238
240
240'
242
244
246
248
250
252
254
256
258
260
2

CRUSHING MACHINE CLEARING SYSTEM

SUMMARY OF THE INVENTION

This is concerned with a crusher clearing system using a plurality of hydraulic jacks and is more specifically concerned with a hydraulic system for clearing the crushing cavity by overcoming the spring release in a gyratory crusher so that uncrushable material may be removed from or allowed to pass through the crushing cavity in a stuck or plugged crusher.

A primary object of the invention is a crusher clearing system in which a plurality of hydraulic jacks are arranged around the crusher effective to apply a generally vertical thrust between the adjustment ring and the main frame.

Another object is a crushing clearing system in which hydraulic jacks are socketed into the crusher.

Another object is a clearing system of the above type in which the jacks are screw-threaded into a part of the crusher so that they apply a thrust directly between the crusher parts in overcoming the spring release.

Another object is a spring release and crusher clearance arrangement which involves the use of jacks disposed in a single row or circle, at intervals, among the springs around the crusher, all mounted under and socketed into the main frame flange.

Another object is a jack screw-threaded into the main frame flange of a crusher.

Another object is a crusher clearing system using a series of small jacks which are imbedded or countersunk into the adjustment ring.

Another object is a jacking system for a crusher clearing mechanism in which the jacks are socketed into a part of the crusher so that a part of the hydraulic pressure is contained by the crusher part.

Another object is a crusher clearing system that uses a plurality of small jacks, for example something on the order of sixteen, disposed at intervals about the crusher, instead of a limited number of large jacks.

Another object is a crusher clearing system which is arranged for a simple fluid circuit.

Other objects will appear from time to time in the ensuing specification and drawings.

DESCRIPTION OF THE PREFERRED EMBODIMENT

Figures 1, 2:
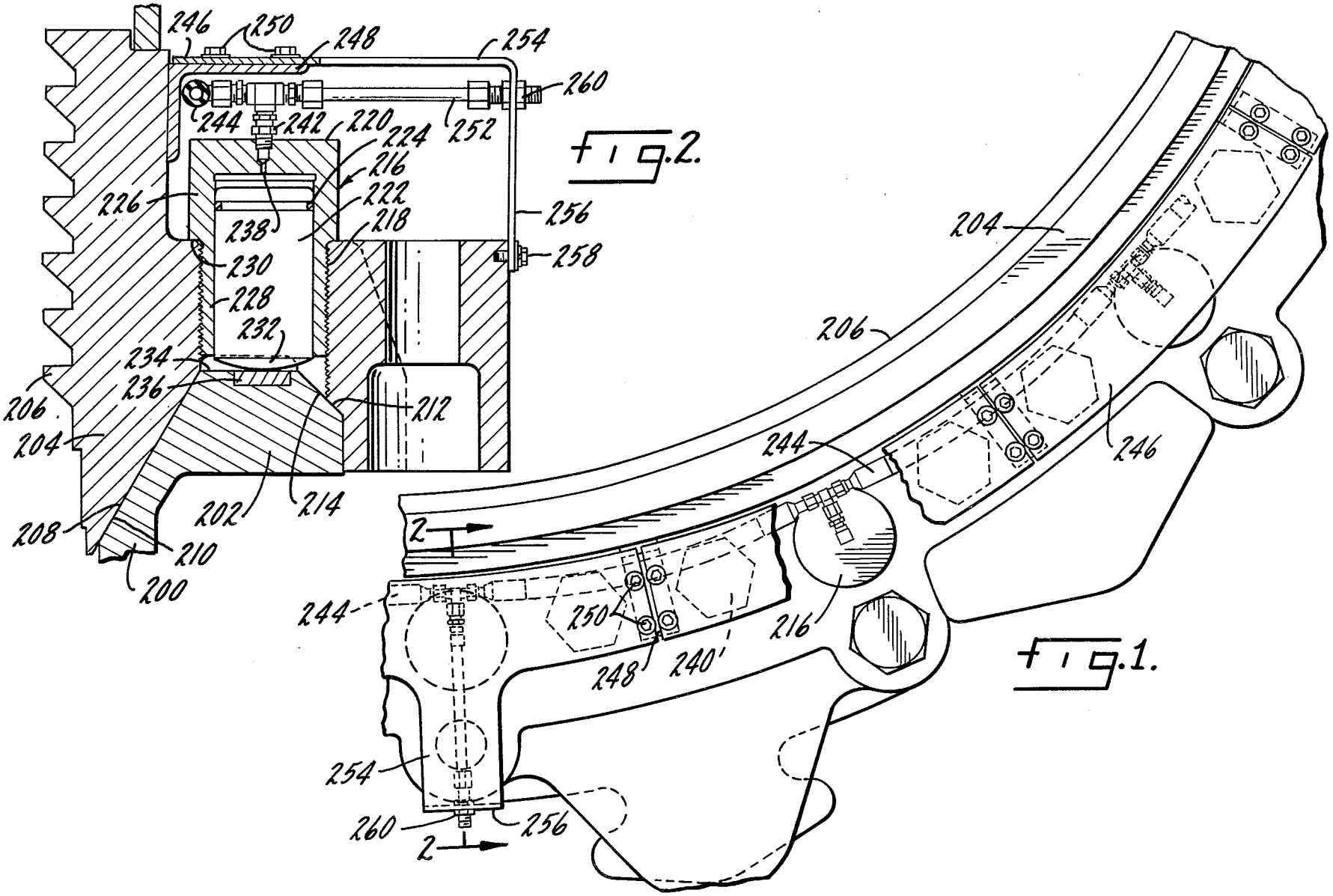
FIG. 1 is a top plane view of a part of a crusher frame with a hydraulic system for crusher clearance shown thereon.
FIG. 2 is a section along line 2—3 of FIG. 1, on an enlarged scale.

The circumferential main frame of a crusher is indicated at 200 with an outstanding circumferential flange 202 at its upper end which supports an adjustment ring 204 which is threaded on its inner surface 206 to adjustably support a bowl in a conventional manner. Upwardly divergent frusto-conical surfaces 208 and 210 between the frame and adjustment ring which extend up and out serve to properly center or position the adjustment ring and bowl, as do outer tapered surfaces 212 and 214 which extend out and down.

A plurality of jack units, indicated generally at 216, are positioned about the crusher with each such jack unit being threaded into socket 218 in the adjustment ring. Each jack unit includes a cylinder 220 and piston

222 with a suitable seal 224 such as an O-ring or the like between them. It will be noted in FIG. 2 that the upper portion 226 of the cylinder has a thicker wall section than the lower portion 228 with a shoulder 230 between them which abuts or engages the upper surface of the adjustment ring to jam the threads between the cylinder and socket. The lower end 232 of the piston is somewhat rounded or convex and the upper exposed flat surface 234 of the main frame flange may have a suitable friction-reducing insert 236 or the like to reduce friction so as to accommodate side shift or lateral thrust when the jack units are energized.

The top of the cylinder contains a small port 238 which is sized to control the discharge of hydraulic fluid in the event of a hydraulic failure when the bowl is raised so that the descent of the bowl will be slowed or controlled. A spring release 240, diagrammatically indicated in FIG. 1, may include a plurality of spring bolts passing through the adjustment ring and main frame flange with coil springs, disposed about the spring bolts or separately, but held by the spring bolts or lower spring retainers to that the adjustment ring and bowl are yieldably held down but may rise when uncrushable material, such as tramp iron, goes through the crushing cavity, all of which may be conventional. The downthrust of the spring release is quite large and in the event of a hydraulic failure when all of the jacks are energized, the springs might slam the bowl and adjustment ring down under great force with possible damage to the machine and/or personnel. But the small discharge ports 238 in the jacks will only let the hydraulic fluid discharge at a controlled rate which may be set so that, in the event of a hydraulic failure, the bowl and adjustment ring will be lowered at a safe rate.

The hydraulic connections 242 may include suitable connectors, T-joints and tubing running from one jack unit to another, as indicated at 244 in FIG. 1. When the jack units are all fully screwed down into their sockets and all of the hydraulic connections are fully and firmly seated, any tendency on the part of a particular jack unit or group of jack units to back off or unthread will be resisted by the hydraulic connections between the jacks. Thus there is no need for a seal, locking key, or setscrew to hold the individual jack units in place.

Since the jacks and connections are on the upper surface of the adjustment ring, a protecting shield is provided which may include a series of arcuate shelves 246 extending edge-to-edge around the crusher and mounted on angle irons 248 at each end thereof and held by suitable screws 250 or the like. The entire hydraulic setup should be connected at one or several points to a hydraulic source through a suitable connection 252, in FIG. 2, which may be protected by an extension 254 on the shelf which may have a downturn leg 256 connected to the side of the adjustment ring at 258 with the hydraulic connection extending through the leg in any suitable manner, as at 260, to a suitable source.

Hydraulic fluid may be supplied to the system by a suitable hand pump, or possibly an electrically-driven pump, or any other simple or complex hydraulic circuitry and source, as desired or required by a particular installation or operation. The shelving 246 will prevent falling rock from damaging or breaking the hydraulic connections and also will serve to prevent personnel from standing or stepping on the connections as they move around or over the crusher in adjusting, repairing or operating it.

The use, operation and function of the invention are as follows:

In the arrangement shown and described, a plurality of individual jacks are used. This arrangement is specifically intended for what may be considered larger machines, for example a 7 ft. or 10 ft. crusher. In the case of a 7 ft. crusher, 16 such jacks might be used, all equally spaced about the crusher and socketed into the adjustment ring at suitable intervals so that, in mass, they raise the adjustment ring and bowl. The particular jack formation has the advantage that it is screwed down into the socket in the adjustment ring and the lower portion of the cylinder is thinner in cross section or has a thinner wall so that the adjustment ring will take some of the hydraulic pressure developed inside of the cylinder. The flow control is built integrally into each jack due to the small inlet and exhaust opening which may slow the speed of raising the adjustment ring, but this is not considered a disadvantage. Since the tops of all of these jacks, if 16 are used, are exposed, a shelf arrangement to protect the various hydraulic connections and fittings is considered important so that they will not be damaged by falling rock or workmen standing on them, or what-have-you. A setscrew or key is not needed to keep the threaded jacks in place, since the various hydraulic piping connections around the crusher will prevent the jacks from backing out or unthreading.

It is also important to have the bottom end of the plungers on each of the jacks somewhat rounded and, preferably, a friction-reducing insert is positioned in the top of the main frame flange so that when the jacks are extended with the spring release partially compressed, any side shift or relative lateral motion due to cocking or what-have-you may be taken care of. The jacks do not need to have an extended travel but, rather, may have an excursion of, say 2 inches which will be adequate for clearing the machine.

While a preferred form and several variations of the invention have been suggested, it should be understood that suitable additional modifications, changes, substitutions and alterations may be made without departing from the invention's fundamental theme. For example, hydraulic circuits have been shown and/or referred to. And it should be understood that fluid circuits might be a more appropriate term because many if not all aspects of the circuits could be hydraulic such as oil, pneumatic such as air or nitrogen, or a combination thereof. And the term fluid should be broadly construed.

Also, where a spring release has been referred to or described, it should be understood that in most instances either mechanical springs or air cylinders or a combination could be used.

The embodiments of the invention in which an exclusive property or privilege is claimed are defined as follows:

1. A hydraulic system or bowl release for a gyratory crusher having a circumferential main frame element, a bowl-supporting ring element tiltably mounted on the upper end of the main frame element and constructed to be releasably held down against the main frame element by a spring release, and a plurality of hydraulic jacks arranged circumferentially about and effective between the main frame and bowl-supporting ring elements, the jacks being at least partially countersunk into one of the elements and operative, as a group, to apply an axial thrust to the other element to elevate the bowl-supporting ring element from the main frame element so that the crushing cavity of the crusher may be cleared of uncrushable material, the hydraulic jacks being countersunk into the bowl-supporting ring element, each of the jacks including a cylinder and piston countersunk and screw-threaded down into the bowl-supporting ring element with a substantial amount of the lower portion of the cylinder being positioned inside of the ring element, the lower portion of the cylinder having a thinner wall section than the upper portion with a shoulder between the two portions in engagement with the upper surface of the bowl-supporting ring element, and friction-reducing elements in the upper surface of the main frame element opposite the piston of each of the jacks to create slippage to accommodate side loads during jacking and cavity clearance.

2. The structure of claim 1 further characterized by and including a protective shell projecting radially outwardly from the bowl-supporting ring element over and covering the jacks and hydraulic system to protect it from damage.

3. In a gyratory crusher, a generally upright main frame with an outstanding circumferential flange at the other end thereof, an adjustment ring mounted on and overlapping the main frame flange with a crushing bowl adjustably mounted therein, a crushing head mounted for gyratory movement within the frame opposite the bowl and defining a crushing cavity therewith, a spring release yieldably holding the adjustment ring on the main frame flange but arranged to yield so that the crushing cavity may be cleared of uncrushable material, and a jacking system for the crusher including a plurality of individual circumferentially disposed small hydraulic jacks imbedded in the overlapping portion of the adjustment ring disposed to apply a collective downthrust to the main frame flange so as to raise the adjustment ring while compressing the spring release, and friction-reducing elements in the upper surface of the main frame flange opposite each of the jacks to create slippage to accommodate side loads during jacking and cavity clearance.

4. The structure of claim 3 further characterized in that the jacks each include a cylinder and piston and are countersunk and screw-threaded down into the adjustment ring with a substantial amount of the lower portion of the cylinder being positioned inside of the adjustment ring, the lower portion of the cylinder having a thinner wall section than the upper portion with a shoulder between the two portions in engagement with the upper surface of the adjustment ring.

5. In a gyratory crusher, a generally upright main frame with an outstanding circumferential flange at the other end thereof, an adjustment ring mounted on and overlapping the main frame flange with a crushing bowl adjustably mounted therein, a crushing head mounted for gyratory movement within the frame opposite the bowl and defining a crushing cavity therewith, a spring release yieldably holding the adjustment ring on the main frame flange but arranged to yield so that the crushing cavity may be cleared of uncrushable material, and a jacking system for the crusher including a plurality of individual circumferentially disposed small hydraulic jacks screw-threaded into the overlapping portion of the adjustment ring disposed to apply a collective downthrust to the main frame flange so as to raise the adjustment ring while compressing the spring release, and permanently mounted hydraulic lines extending circumferentially around the adjustment ring interconnecting the jacks so that they will not unscrew.

6. The structure of claim 5 further characterized by and including friction-reducing elements in the upper surface of the main frame opposite each of the jacks to create slippage to accommodate side loads during jacking and cavity clearance.

* * * * *